US010508892B1

(12) United States Patent
Pines et al.

(10) Patent No.: US 10,508,892 B1
(45) Date of Patent: Dec. 17, 2019

(54) DISTRIBUTED FUZE ARCHITECTURE FOR HIGHLY RELIABLE SUBMUNITIONS

(71) Applicant: Department of the Navy, Indian Head, MD (US)

(72) Inventors: Daniel Corey Pines, Alexandria, VA (US); Kevin Cochran, Falls Church, VA (US); John Hendershot, Dunkirk, MD (US); John Frederick Kunstmann, King George, VA (US); David Reinaldo Gonzalez, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/330,140

(22) Filed: Aug. 15, 2016

(51) Int. Cl.
*F42C 15/40* (2006.01)
*F42B 12/58* (2006.01)
*F42B 10/56* (2006.01)

(52) U.S. Cl.
CPC ..... *F42C 15/40* (2013.01); *F42B 10/56* (2013.01); *F42B 12/58* (2013.01)

(58) Field of Classification Search
CPC ..... F42C 15/00; F42C 15/40; F42B 10/56; F42B 12/56; F42B 12/58
USPC .... 102/393, 478, 491, 494–496, 202.5, 206, 102/217
See application file for complete search history.

(56) References Cited

U.S. PATENT DOCUMENTS 3,968,748 A * 7/1976 Burford ..... F42B 12/10 102/394
4,175,491 A * 11/1979 Thomanek ..... F42B 10/14 102/397
4,178,851 A * 12/1979 Brady ..... F42B 10/56 102/393
4,428,293 A 1/1984 Botwin et al.
4,458,596 A * 7/1984 Armstrong ..... F42B 12/10 102/364
4,498,393 A * 2/1985 Fischer ..... F42B 12/62 102/387
4,669,386 A * 6/1987 Precoul ..... F42B 10/46 102/386
4,714,020 A * 12/1987 Hertsgaard ..... F42B 3/04 102/275.11
4,833,991 A * 5/1989 Furst ..... F42C 15/40 102/206
4,848,235 A * 7/1989 Postler ..... F42C 15/184 102/393

(Continued)

FOREIGN PATENT DOCUMENTS

DE 3326877 A1 * 2/1985 ..... F41G 7/2233

*Primary Examiner* — John Cooper
(74) *Attorney, Agent, or Firm* — Frederic J. Zimmerman

(57) ABSTRACT

A submunition delivery device including a master electronics module; a submunition module operatively connected to the master electronics module and including a plurality of submunition banks separated by bulkheads. Each of the submunition banks includes a plurality of submunitions; a base plug module operatively connected to the submunition module; and a distributed fuze module operatively connected to the master electronics module to limit a detrimental effect of the plurality of submunitions upon a collision by arming the plurality of submunitions before a dispense action.

16 Claims, 15 Drawing Sheets

(56) References Cited

U.S. PATENT DOCUMENTS 4,852,496 A * 8/1989 Campagnuolo ..... F42C 15/23 102/322
4,974,515 A * 12/1990 Busch ..... F42B 12/105 102/476
5,191,169 A * 3/1993 Hu ..... F42B 12/14 102/476
5,387,917 A * 2/1995 Hager ..... F42C 13/045 342/122
5,452,864 A 9/1995 Alford et al.
5,668,346 A * 9/1997 Kunz ..... F42B 10/56 102/211
5,789,695 A * 8/1998 Scherer ..... F42B 33/06 86/1.1
6,502,786 B2 1/2003 Rupert et al.
6,666,402 B2 12/2003 Rupert et al.
7,163,176 B1 1/2007 Geswender et al.
7,354,017 B2 4/2008 Morris et al.
7,490,555 B2 * 2/2009 Veksler ..... F42B 12/208 102/393
7,726,244 B1 * 6/2010 Lloyd ..... F41H 11/12 102/402
8,076,623 B2 12/2011 Dryer
8,319,163 B2 * 11/2012 Flood ..... F16C 19/52 102/501
8,528,480 B2 * 9/2013 Seidel ..... F42B 10/02 102/492
8,552,349 B1 10/2013 Alexander
8,661,980 B1 * 3/2014 Roemerman ..... F42B 12/64 102/489
8,661,981 B2 * 3/2014 Tepera ..... F42B 12/60 102/351
8,931,416 B2 * 1/2015 Schneider ..... F42B 12/60 102/449
8,985,025 B1 * 3/2015 Manz ..... F42B 12/58 102/489
2003/0070571 A1 * 4/2003 Hodge ..... F42C 15/34 102/221
2004/0041059 A1 * 3/2004 Kennedy ..... F42B 10/14 244/3.29

* cited by examiner

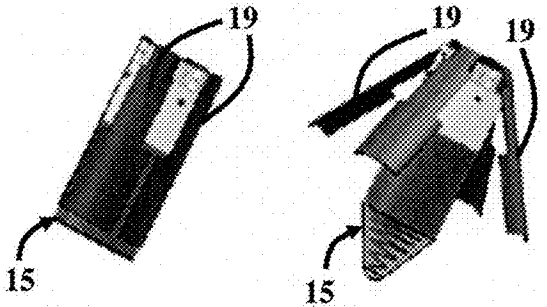
FIG. 4A
FIG. 4B
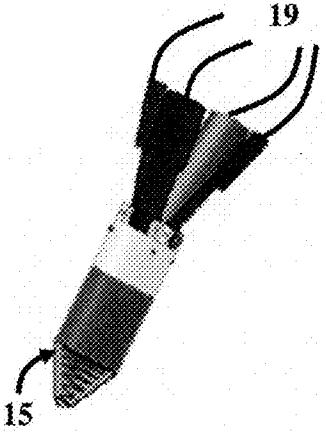
FIG. 4C
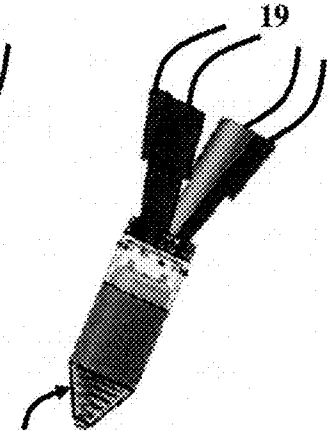
FIG. 4D

DISTRIBUTED FUZE ARCHITECTURE FOR HIGHLY RELIABLE SUBMUNITIONS

GOVERNMENT INTEREST

The embodiments described herein may be manufactured, used, and/or licensed by or for the United States Government without the payment of royalties thereon.

BACKGROUND

Technical Field

The embodiments herein relate to ordnance systems, and more particularly to ordnance with submunitions.

Description of the Related Art

Weapon systems, for example ordnance, may include submunitions. Ordnance or the submunitions may be controlled by a control system having fins, parachutes or aero-decelerators as part of a control system. The aero-surfaces provided by fins, parachutes or air-decelerators may impact the projectile of the missile or submunition. A weapon system may include multiple submunitions and a housing mechanism for holding the submunitions. Increasing accuracy and reducing unexploded ordnance (UXO) is a goal in designing and operating submunitions.

SUMMARY

In view of the foregoing, an exemplary embodiment herein provides a submunition delivery device, including a master electronics module; a submunition module operatively connected to the master electronics module and including a plurality of submunition banks separated by bulkheads, where each of the submunition banks includes a plurality of submunitions; a base plug module operatively connected to the submunition module; and a distributed fuze module operatively connected to the master electronics module to limit a detrimental effect of the plurality of submunitions upon a collision by arming the plurality of submunitions before a dispense action.

The master electronic module may include a single instance of an electronic device. The single instance of an electronic device may include environmental sensors. The distributed fuze module may include an electronic detonator configured to be sensitive to off angle of attack. Each of the plurality of submunitions may include a warhead; a fuze can adaptor connected to the warhead; an electronic submunition fuze operatively connected to the warhead, where the electronic submunition fuze includes any of a high voltage fireset with initiator and a microelectromechanical systems (MEMS) safe and arm device; and a plurality of aero-dynamic elements operatively connected to a submunition, where the plurality of aero-dynamic elements comprises any of fins, parachutes, and air-decelerators.

The plurality of aero-dynamic elements may be mounted around the periphery of the submunition, where the plurality of aero-dynamic elements each have a retracted position and an extended position, and wherein in the extended position, the plurality of aero-dynamic elements extend generally radially from a longitudinal axis of the submunition. Each of the plurality of submunitions may further include a plurality of first connectors where the first connectors include any of contact pins and first plugs.

In an embodiment, the nesting device may include a spacer material; and a plurality of elongated openings in the spacer material, where a diameter of each of the elongated openings is complementary to a diameter of each of the submunitions. Each of the elongated openings may include a plurality of second connectors, wherein the plurality of second connectors comprises any of a plurality of strips in broached t-slots and a plurality of second plugs on electronic cables, and where the first connectors and the second connectors are configured to connect the electronic submunition fuze of each of the submunitions to the master electronic module.

The number of the plurality of first connectors of each of the plurality of submunitions may be equal to a number of the plurality of second connectors of each of the elongated openings. The plurality of strips may include brass material and the electronic cables may include any of copper and polyamide based material.

Another exemplary embodiment provides a submunition delivery system including a dispense fuze; a master electronics module operatively connected to the dispense fuze and configured to include a single instance of an electronic device in the master electronic module; a submunition module operatively connected to the master electronics module and including a plurality of submunition banks separated by bulkheads, where each submunition bank includes a plurality of elongated submunitions of similar sizes; and a base plug operatively connected to the submunition module.

Each of the plurality of submunitions may include a warhead; a fuze can adaptor connected to the warhead; an electronic submunition fuze operatively connected to the warhead, where the electronic submunition fuze includes any of a high voltage fireset with initiator and a MEMS safe and arm device; and a plurality of aero-dynamic elements operatively connected to a submunition, where the plurality of aero-dynamic elements comprises any of fins, parachutes, and air-decelerators The plurality of aero-dynamic elements may be mounted around the periphery of a submunition, where the plurality of aero-dynamic elements have a retracted position and an extended position, and where in the extended position, the plurality of aero-dynamic elements extend generally radially from the longitudinal axis of each of the submunitions. Each of the plurality of submunitions may further comprise a plurality of first connectors where the first connectors comprise any of contact pins and first plugs.

The nesting module may include a spacer material; and a plurality of elongated openings in the spacer material, where a diameter of each of the elongated openings is complementary to a diameter of each of the submunitions. The elongated openings may include a plurality of second connectors, where the plurality of second connectors includes any of a plurality of strips in broached t-slots and a plurality of second plugs on electronic cables.

The number of the plurality of first connectors of each of the plurality of submunitions may be equal to a number of the plurality of second connectors of each of the elongated openings, and where the first connectors and the second connectors are configured to connect the electronic submunition fuze of each of the submunitions to the master electronic module Another embodiment herein provides a method for operating a submunition delivery system including arranging a plurality of submunitions in a nesting device, where the nesting device includes a spacer material, and a plurality of elongated openings of similar sizes in the spacer material, where a diameter of each of the elongated openings is complementary to a diameter of each of the submunitions, where each of the elongated openings includes a plurality of connectors, and where the plurality of connectors includes any of a plurality of strips in broached t-slots and a plurality of flexible electronic cabling. The method may further include arming the plurality of submunitions, using a distributed fuze architecture, before a dispense action; and configuring the plurality of submunitions, using the distributed fuze architecture, to limit a detrimental effect of the submunitions upon a collision.

These and other aspects of the exemplary embodiments herein will be better appreciated and understood when considered in conjunction with the following description and the accompanying drawings. It should be understood, however, that the following descriptions, while indicating exemplary embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which:

FIG. 4A is a schematic diagram illustrating a submunition with aero-elements in a retracted stage of deployment according to an embodiment herein;

FIG. 4B is a schematic diagram illustrating a submunition with aero-elements in a preliminary extended stage of deployment according to an embodiment herein;

FIG. 4C is a schematic diagram illustrating a submunition with aero-elements in a nearly full extended stage of deployment according to an embodiment herein;

FIG. 4D is a schematic diagram illustrating a submunition with aero-elements in an extended stage of deployment according to an embodiment herein;

DETAILED DESCRIPTION

Figure 1:
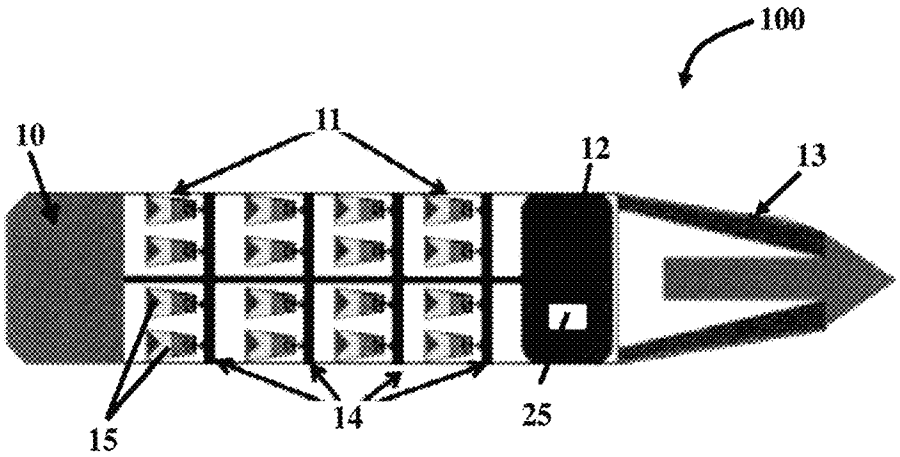
FIG. 1 is a schematic diagram illustrating a submunition delivery device according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide a distributed fuze architecture for highly reliable submunitions. Referring now to the drawings, and more particularly to FIGS. 1 through 7, where similar reference characters denote corresponding features consistently throughout the figures, there are shown exemplary embodiments.

FIG. 1 is a schematic diagram illustrating a submunition delivery device 100 according to an embodiment herein. In an exemplary embodiment, the various modules or devices described herein and illustrated in the figures may be embodied as hardware-enabled modules or devices and may be configured as a plurality of overlapping or independent electronic circuits, devices, and discrete elements packaged onto a circuit board to provide data and signal processing functionality within an electronic controller, that may include any of a computing device with a processor, a field programmer gate array (FPGA), and an application specific hardware. An example might be a comparator, inverter, or flip-flop, which could include a plurality of transistors and other supporting devices and circuit elements. The modules or devices that are configured with electronic circuits process computer logic instructions capable of providing digital and/or analog signals for performing various functions as described herein. The various functions may further be embodied and physically saved as any of data structures, data paths, data objects, data object models, object files, database components. For example, the data objects could be configured as a digital packet of structured data. The data structures could be configured as any of an array, tuple, map, union, variant, set, graph, tree, node, and an object, which may be stored and retrieved by computer memory and may be managed by processors, compilers, and other computer hardware components. The data paths may be configured as part of a computer CPU that performs operations and calculations as instructed by the computer logic instructions. The data paths could include digital electronic circuits, multipliers, registers, and buses capable of performing data processing operations and arithmetic operations (e.g., Add, Subtract, etc.), bitwise logical operations (AND, OR, XOR, etc.), bit shift operations (e.g., arithmetic, logical, rotate, etc.), complex operations (e.g., using single clock calculations, sequential calculations; iterative calculations, etc.). The data objects may be configured as physical locations in computer memory and may be a variable, a data structure, or a function. In the embodiments configured as relational databases (e.g., such Oracle® relational databases), the data objects may be configured as a table or column. Other configurations include specialized objects, distributed objects, object oriented programming objects, and semantic web objects, for example. The data object models may be configured as an application programming interface for creating HyperText Markup Language (HTML) and Extensible Markup Language (XML) electronic documents. The models may be further configured as any of a tree, graph, container, list, map, queue, set, stack, and variations thereof. The data object files are created by compilers and assemblers and contain generated binary code and data for a source file. The database components may include any of tables, indexes, views, stored procedures, and triggers.

An elongated submunition delivery device 100 may include a dispense fuze module 13, a master electronics module 12, a base plug module 10, and a submunition module comprising submunition banks 11 separated by bulkheads 14. Each of the submunition banks 11 may include elongated submunitions 15 of similar sizes.

The submunition delivery device 100 also may be configured to include a single instance of an electronic device 25 only in the master electronic module 12. Therefore there may be no need to have other instances of the electronic device 25 according to an embodiment. The specific electronic device may include an environmental sensor, or a master safe and arm device.

Figure 2:
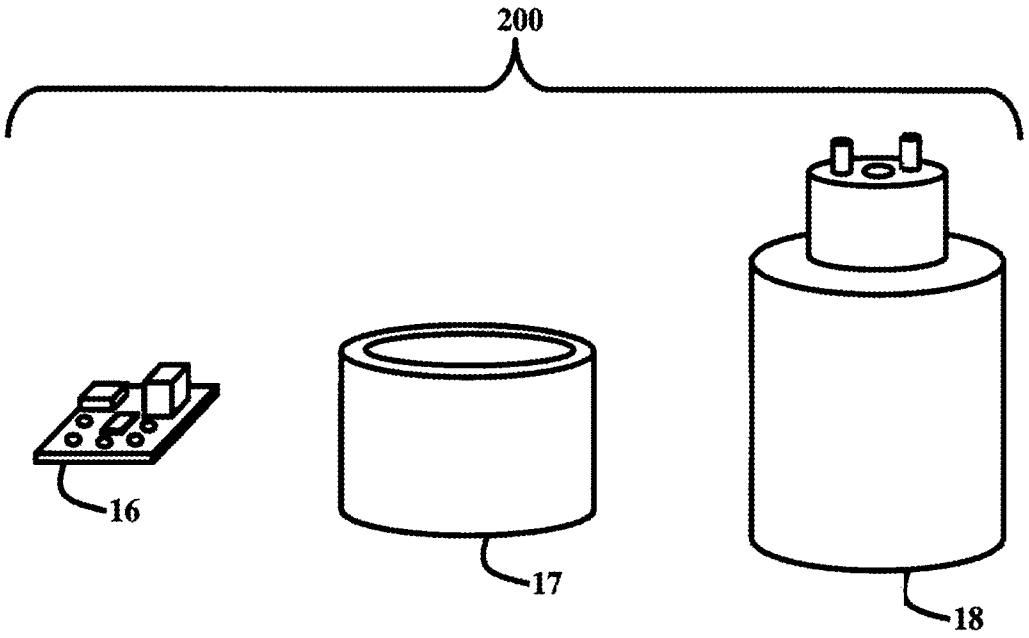
FIG. 2 is an image illustrating modules of a submunition according to an embodiment herein.

FIG. 2, with reference to FIG. 1, is an image illustrating modules 200 of the submunitions 15 according to an embodiment herein. In an embodiment, each of the submunitions 15 include an electronic submunition fuze 16, a fuze can adaptor 17, and a warhead 18. An electronic submunition fuze 16 may include a high voltage fireset with initiator or a microelectromechanical systems (MEMS) safe and arm device. The fuze can adaptor 17 may be removably or permanently connected to the warhead 18.

Figure 3A:
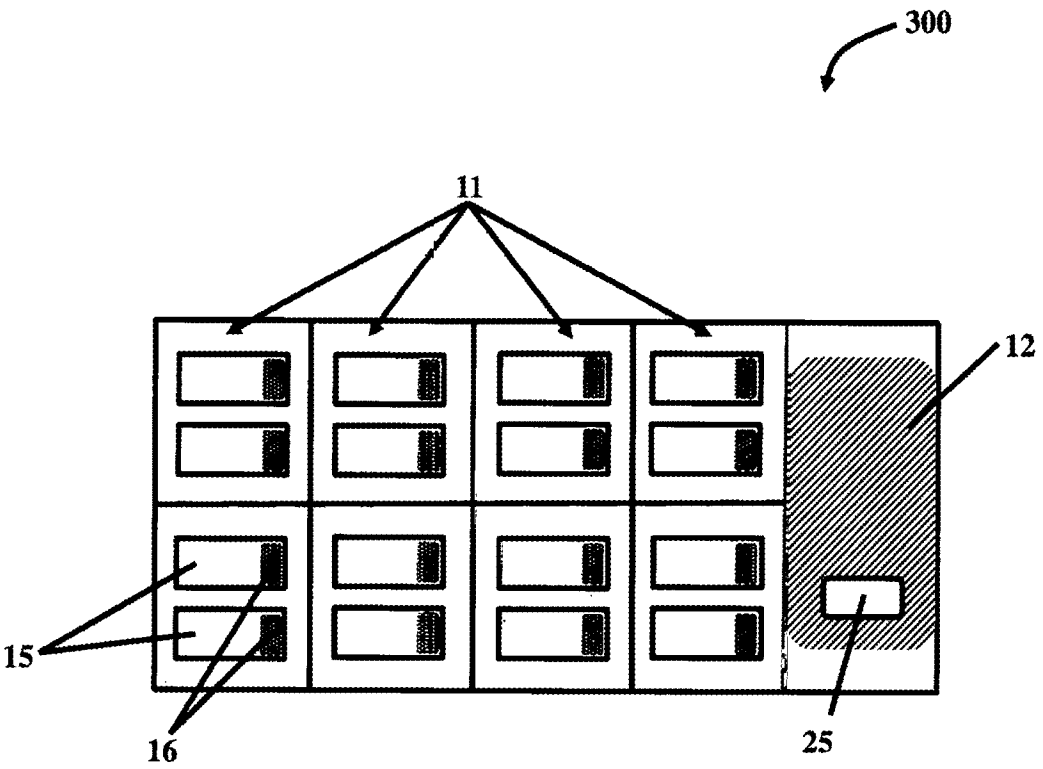
FIG. 3A is a schematic diagram illustrating a distributed fuze architecture according to an embodiment herein.

FIG. 3A, with reference to FIGS. 1 through 2, is a schematic diagram illustrating a distributed fuze architecture 300 for the submunition delivery device 100. Each submunitions 15 may include a submunition fuze 16. The submunitions 15 may be configured to, using the submunition fuze 16, limit the detrimental effect of the submunitions 15 upon a collision by arming the submunitions 15 before a dispense action.

Figure 3B:
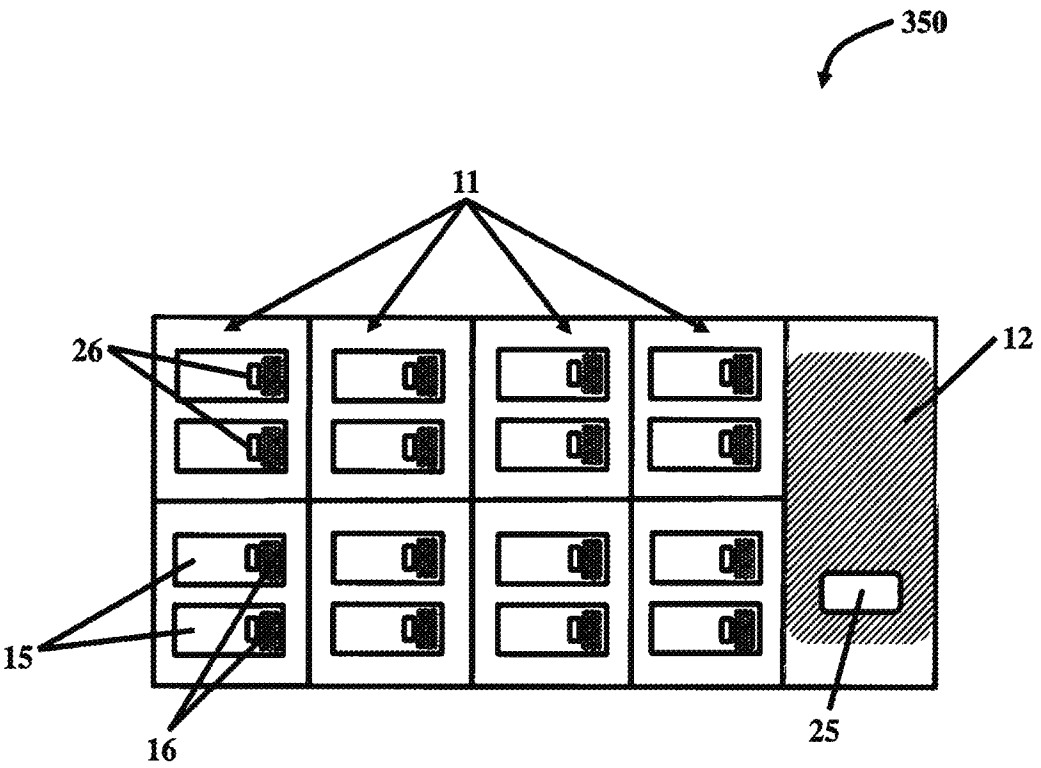
FIG. 3B is a schematic diagram illustrating electronic detonators according to an embodiment herein.
Figure 4E:
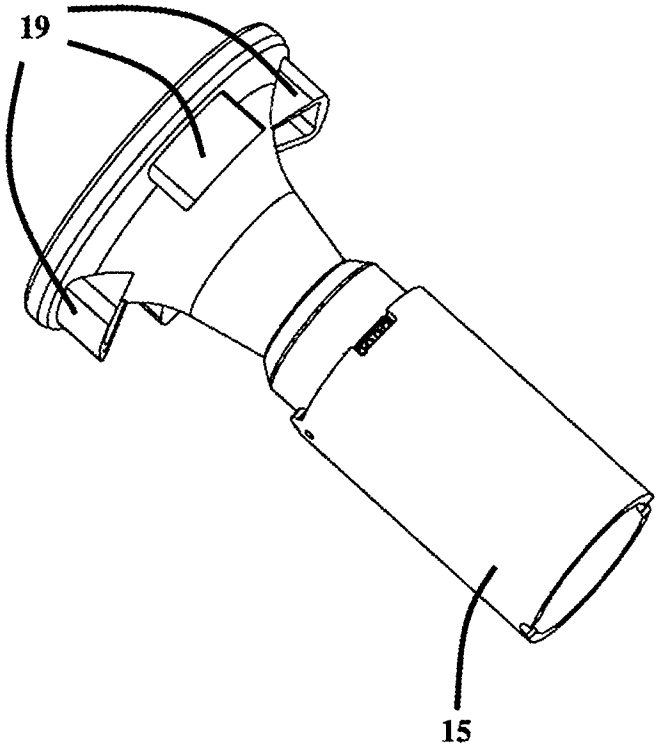
FIG. 4E is a schematic diagram illustrating a submunition with air-decelerator aero-elements in an extended stage of deployment according to an embodiment herein.

FIG. 3B, with reference to FIGS. 1 through 3A, is a schematic diagram illustrating a distributed fuze architecture 350 with electronic detonators 26 for the submunition delivery device 100. Each submunition 15 may include an electronic detonator 26 to replace a traditional mechanical stab firing pin detonator. Electronic detonators 26 may be configured to be sensitive to off angle of attack. In an embodiment submunitions fuze 16, that may include any of a high voltage fireset with initiator or a MEMS safe and arm device, may include electronic detonators 26 for each submunition 15.

FIGS. 4A through 4D, with reference to FIGS. 1 through 3B, are schematic diagrams illustrating a submunition 15 with aero-elements 19 in various stages of deployment according to an embodiment herein. According to exemplary embodiments herein, aero-elements 19 may include at least one of air-decelerators, parachutes, and fins.

In an embodiment, the aero-elements 19 are mounted around the periphery of the submunitions 15, and the aero-elements 19 may have a retracted position and an extended position. For example, FIG. 4A shows the aero-elements 19 in the retracted position, FIG. 4B shows the aero-elements 19 in a preliminary extended position, FIG. 4C shows the aero-elements 19 in a nearly full extended position, and FIG. 4D shows the aero-elements 19 in the extended position. In the extended position, the aero-elements 19 extend generally radially from the longitudinal axis of submunitions 15.

In an embodiment, the aero-elements 19 may include one or more of deployment stages illustrated in FIGS. 4A through 4D. For example, an aero-elements 19 may only have one fix deployed stage. FIG. 4E, with reference to FIGS. 1 through 4D, is an image illustrating a submunition 15 with air-decelerator aero-elements 19 in an extended stage of deployment according to an embodiment. In an embodiment, each of the submunitions 15 include an electronic submunition fuze 16, a fuze can adaptor 17, a warhead 18, and aero-elements 19. Electronic submunition fuze 16 may replace the traditional mechanical stab firing pin detonator.

Figure 5A:
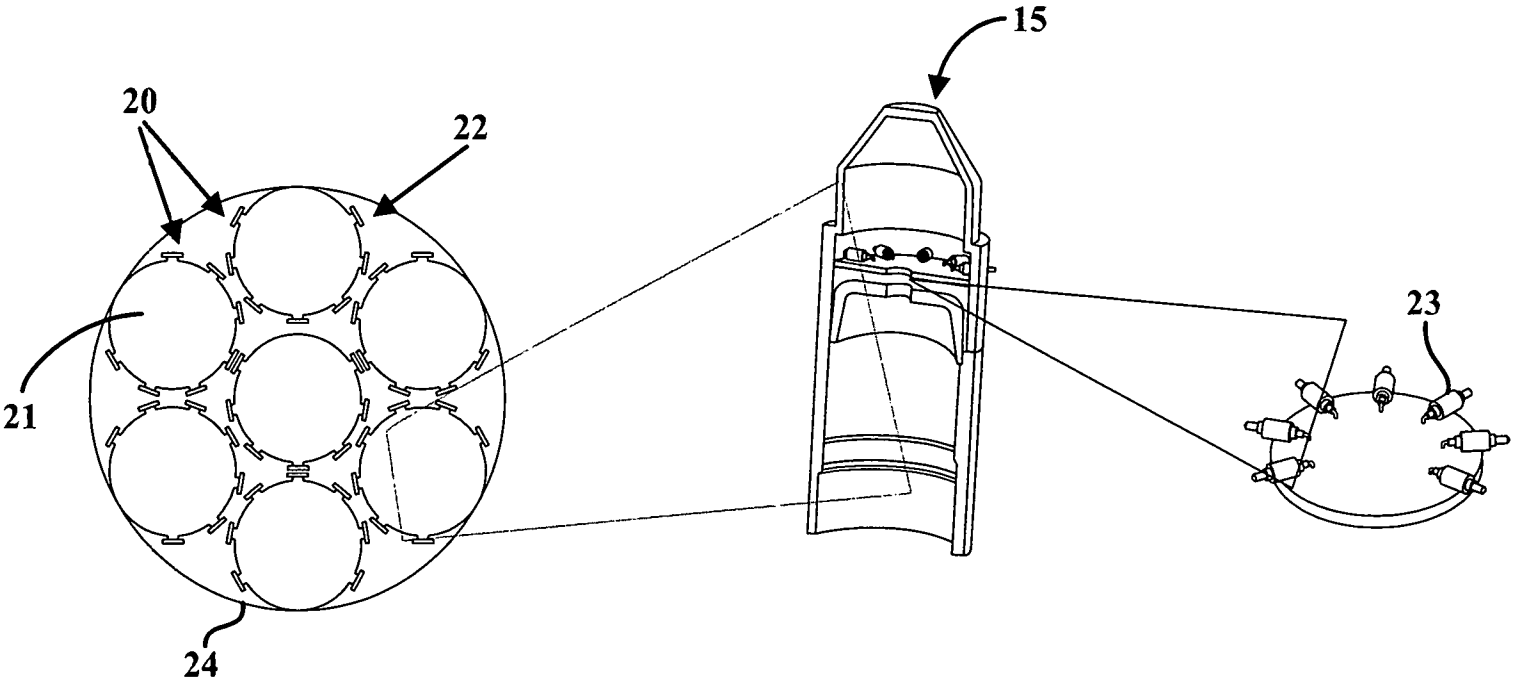
FIG. 5A is a schematic diagram illustrating a nesting device for submunitions according to an embodiment herein.

FIG. 5A, with reference to FIGS. 1 through 4E, is a schematic diagram illustrating a nesting device 24 for submunitions 15 according to an embodiment herein. Each of the submunitions 15 may include contact pins 23 for nesting the submunition 15 in a nesting device 24. Submunition 15 may have any suitable number of contact pins 23. In the example embodiment of FIG. 5A, submunition 15 has seven contact pins 23. In an embodiment, the nesting device 24 includes a spacer material 22 and elongated openings 21. The elongated openings 21 may be of similar sizes. The diameter of each of the elongated openings 21 may be complementary to the diameter of each of the submunitions 15.

In an embodiment, each of the elongated openings 21 may include strips 20. The strips 20 may be configured in broached t-slots or flexible electronic cabling. The strips 20 may be made from a brass material. In an exemplary embodiment, the number of the strips 20 in the broached t-slots of each of the elongated openings 21 is equal to the number of the contact pins 23 of each of the submunitions 15. In an embodiment, pins 23 and strips 20 electronically connect the electronic submunition fuzes 16 to the master electronic module 12 or to a master safe and arm device in the master electronic module 12. In an embodiment, the strips 20 include brass material.

Figure 5B:
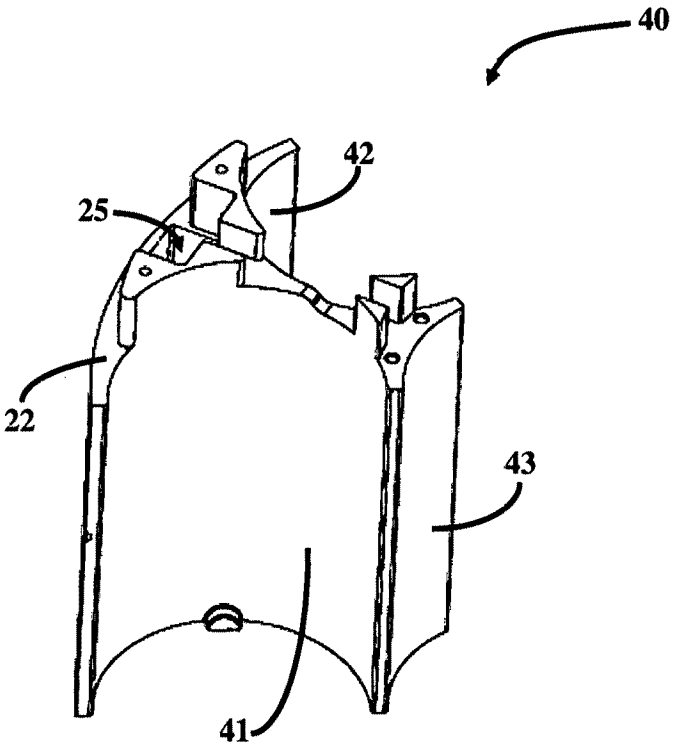
FIG. 5B is an image illustrating a filler portion of the nesting device according to an embodiment herein.

FIG. 5B, with reference to FIGS. 1 through 5A, is an image illustrating a filler portion 40 of the nesting device 24 according to an embodiment. The spacer material 22 of the nesting device 24 may include filler portions 40. Nesting device 24 may be constructed by connecting filler portions 40. Each filler portion 40 may include a first curved side 41, a second curved side 42, and a third curved side 43, each configured to cover a side portion of submunitions 15. Filler portion 40 may include an elongated opening 25 configured to house an electronic cable for connecting to submunitions 15.

Figure 5C:
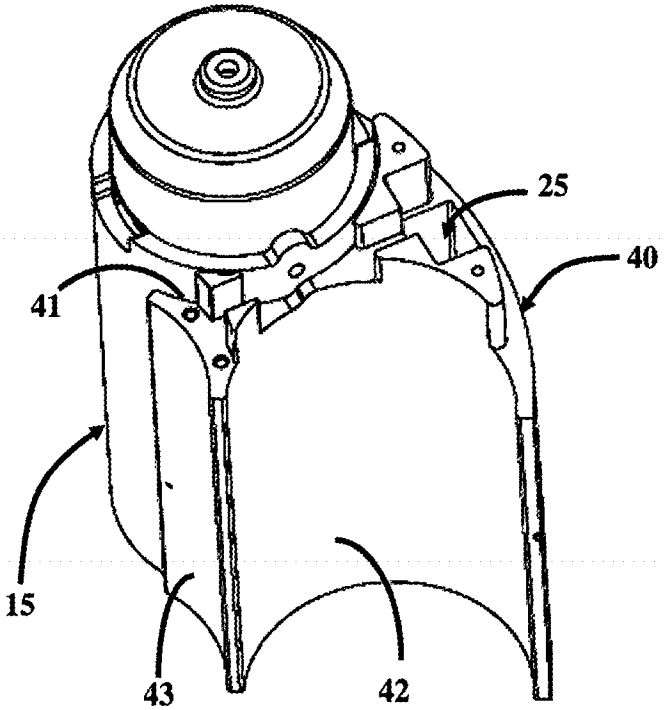
FIG. 5C is an image illustrating a filler portion of a nesting device and a submunition according to an embodiment herein.

FIG. 5C, with reference to FIGS. 1 through 5B, is an image illustrating the filler portion 40 of the nesting device 24 configured to cover a side portion of submunitions 15 according to an embodiment. In the exemplary embodiment shown in FIG. 5C, the first curved side 41 of the filler portion 40 is configured to fit and cover a side portion of the submunition 15.

Figure 5D:
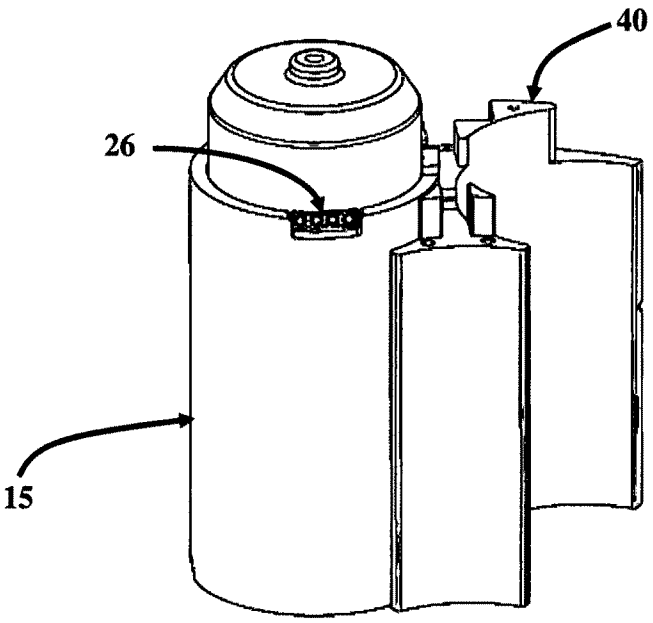
FIG. 5D is an image illustrating a plug on a submunition and a filler portion of a nesting device according to an embodiment herein.

FIG. 5D, with reference to FIGS. 1 through 5C, is an image illustrating a plug 26 on the submunition 15. The plug 26 may connect the submunition 15 to an electronic cable in the nesting device 24. Accordingly, the submunition 15 may include contact pins 23, at least one plug 26, or both. In the exemplary embodiment shown in FIG. 5D, a side portion of the submunition 15 is covered by the filler portion 40 of the nesting device 24. In an embodiment, the filler portion 40 keeps the plug 26 uncovered.

Figure 5E:
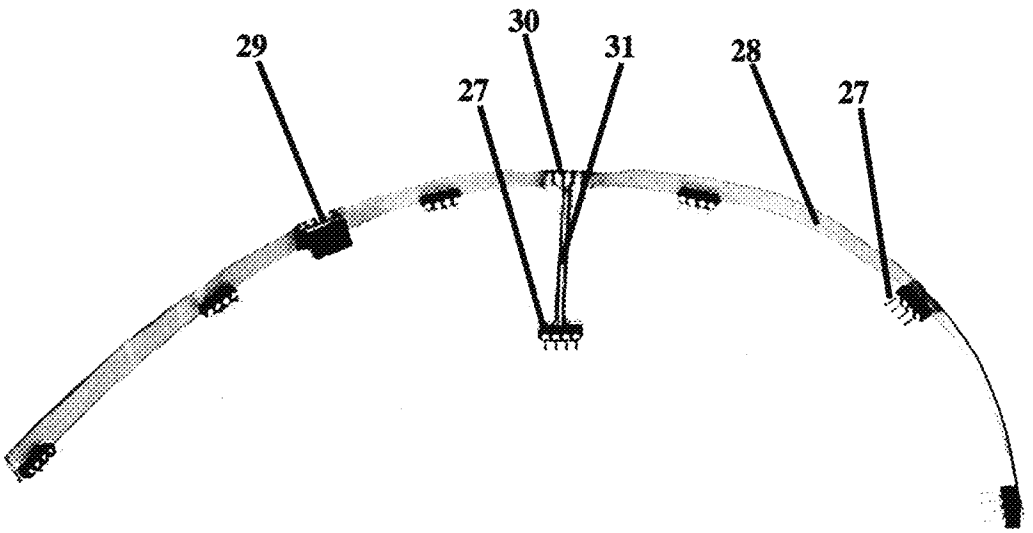
FIG. 5E is an image illustrating an electronic cable for connecting the submunitions in a nesting device according to an embodiment herein.

FIG. 5E, with reference to FIGS. 1 through 5D, is an image illustrating an electronic cable 28 for connecting to the submunitions 15 in the nesting device 24 according to an embodiment. In an embodiment, plugs 27 are connected to the electronic cable 28. Plugs 27 may be configured to connect to plugs 26 of the submunitions 15. An extension electronic cable 31 may be connected to cable 28 via a connector 30. Cable 31 may also include a plug 27 for connecting to a plug 26 of a submunition 15. In the exemplary embodiment of FIG. 5E, seven plugs 27 are connected to electronic cables 38 and 31.

Figure 5F:
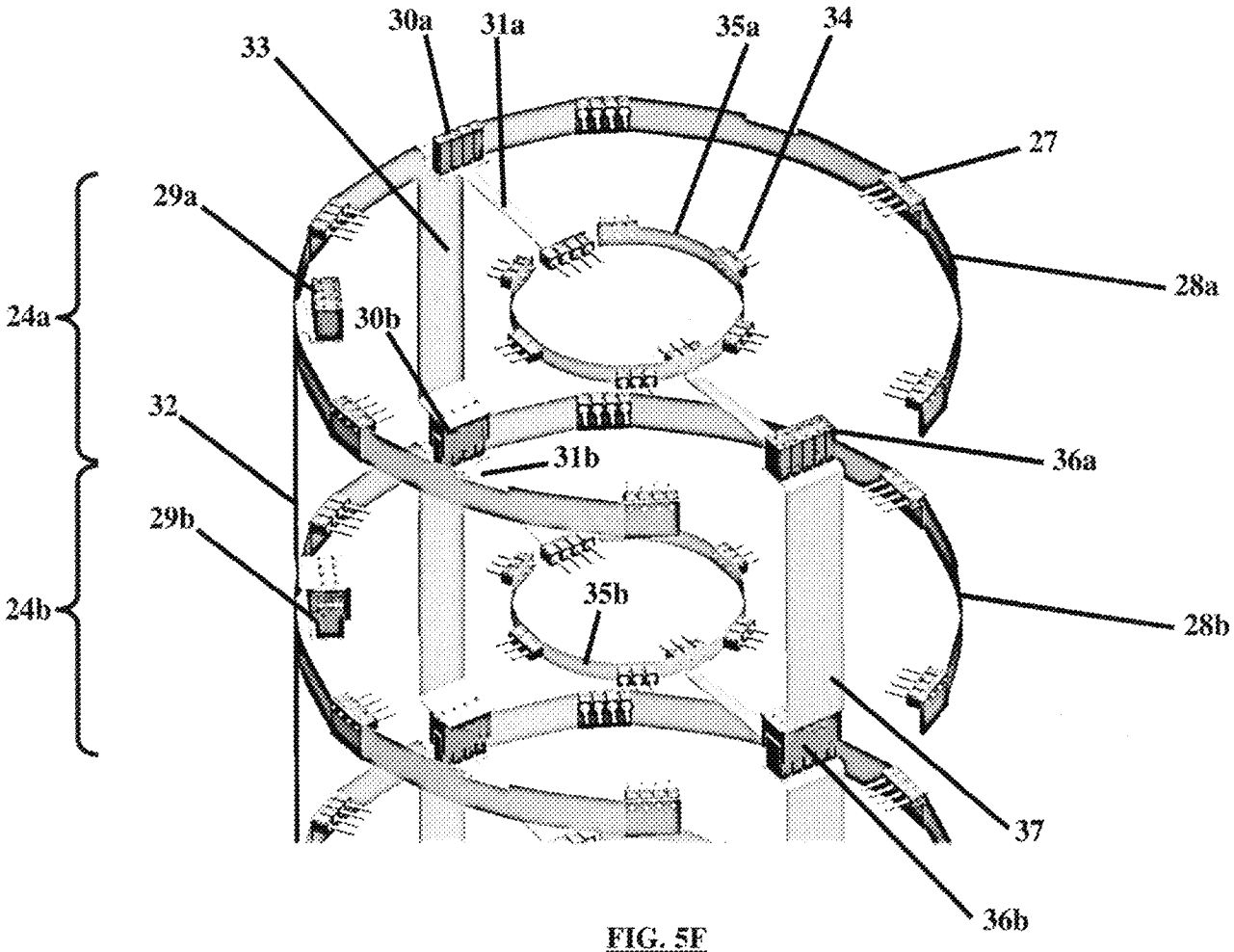
FIG. 5F is an image illustrating an arrangement of electronic cables for connecting the submunitions in the nesting device according to an embodiment herein.

FIG. 5F, with reference to FIGS. 1 through 5E, is an image illustrating electronic cables 28*a*, 31*a*, and 35*a*, according to an embodiment. The electronic cables 28, 31, 28*a*, 31*a*, and 35*a* may be composed of copper, a polyamide based material, or both. Electronic cables 28*a*, 31*a*, and 35*a* may connect one layer of submunitions 15 in the nesting device 24. In an embodiment, each of submunitions 15 includes two plugs, one plug for connecting to electronic cable 28*a* and another for connecting to electronic cable 35*a*. Submunitions 15 may connect to plugs 27 on electronic cable 28*a*, and connect to plugs 34 on electronic cable 35*a*. In an embodiment, an extension electronic cable 31 may be connected to cable 28 via a connector 30.

According to an embodiment, electronic cables 28*a* and 35*a* may be configured in circular shapes such that one submunition may be located within the perimeter of the electronic cable 35*a* and multiple submunitions may be located outside the perimeter of the electronic cable 35*a* and inside the perimeter of the electronic cable 28*a*. In the exemplary embodiment shown in FIG. 5F, one submunition may be located within the perimeter of the electronic cable 35*a* and six submunitions may be located outside the perimeter of the electronic cable 35*a* and inside the perimeter of the electronic cable 28*a*.

In an embodiment, electronic cables 28*a*, 28*b*, 31*a*, 31*b*, 35*a*, and 35*b* may be configured to connect multiple layers of the submunitions 15 in the nesting device 24. In an embodiment electrical cable 32 and electrical cable 33 connect electrical cable 28*a* of a first stack 24*a* of submunitions 15 to the electronic cable 28*b* of a second stack 24*b* of submunitions 15. Electronic cable 32 may connect to connector 29*a* and connector 29*b*. Cable 33 may connect to connectors 30*a* and 30*b*. Electronic cable 37 may connect electrical cable 35*a* of a first stack 24*a* of submunitions 15 to the electronic cable 35*b* of a second stack 24*b* of submunitions 15. In an embodiment, the first stack of electronic cables 28*a* and 35*a* may connect to the second stack of electronic cables 28*b* and 35*b* by electronic cables 32, 33, and 37. Cable 32 may connect connection 29*a* on the electronic cable 28*a* to connection 29*b* on the electronic cable 28*b*. Cable 33 may connect connection 30*a* on the electronic cable 28*a* to connection 30*b* on the electronic cable 28*b*. Cable 37 may connect connection 36*a* on the electronic cable 35*a* to connection 36*b* on the electronic cable 35*b*.

An embodiment may include one or more layers of the electronic cables and the submunitions 15 in a nesting device 24. In an embodiment, electronic cables connect electronic submunition fuzes 16 to the master electronic module 12 or to the master safe and arm device in the master electronic module 12. In an embodiment, the electronic cables may be flexible electronic cables.

Figure 5H:
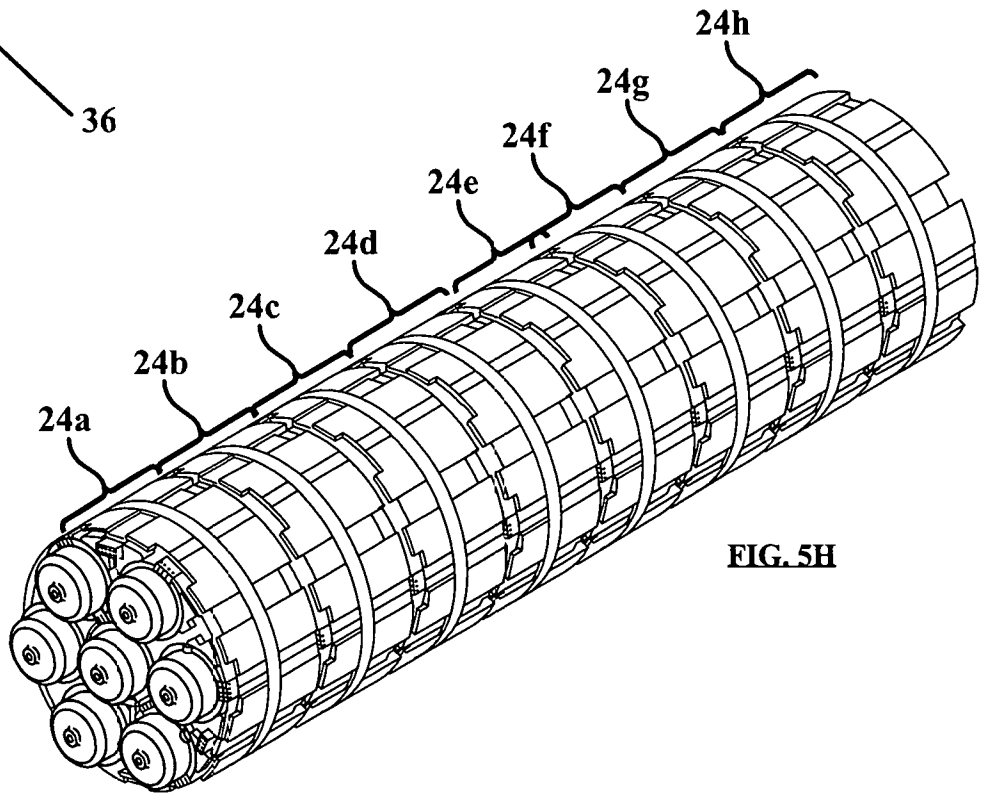
FIG. 5H is an image illustrating stacked submunitions and electronic cables in nesting devices according to an embodiment herein.
Figure 5G:
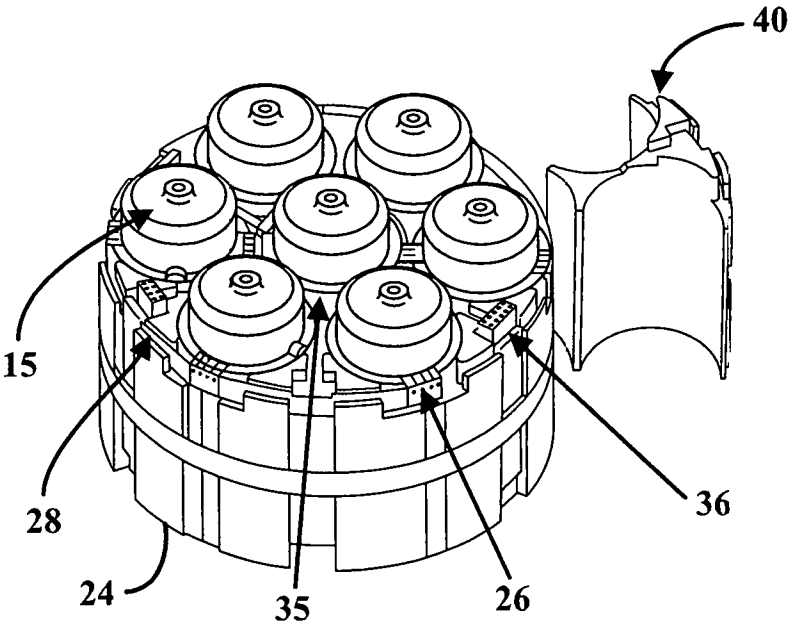
FIG. 5G is an image illustrating submunitions and electronic cables in a nesting device according to an embodiment herein.

FIG. 5G, with reference to FIGS. 1 through 5F, is an image illustrating submunitions 15 and electronic cables 28 and 35 in nesting device 24 according to an embodiment. Nesting device 24 may be assembled by connecting filler portions 40 according to an embodiment herein. In an embodiment, electronic cables connecting submunitions 15 in FIG. 5G are arranged similar to the first stack of electronic cables in FIG. 5F.

FIG. 5H, with reference to FIGS. 1 through 5F, is an image illustrating stacked submunitions 15 and electronic cables in nesting devices. In the exemplary embodiment illustrated in FIG. 5H, eight nesting devices 24*a*, 24*b*, 24*c*, 24*d*, 24*e*, 24*f*, 24*g*, and 24*h* including submunitions 15 connected by electronic cables are stacked. In an embodiment, submunitions 15 and adjacent nesting devices 24 are connected by an arrangement of cables illustrated in FIG. 5F. In an embodiment, electronic cables may be flexible electronic cables. In an embodiment, each submunition bank 11 may include a stacked submunitions nesting devices. In an embodiment, submunition module of elongated submunition delivery device 100 may include the stacked submunitions nesting devices.

Figure 6:
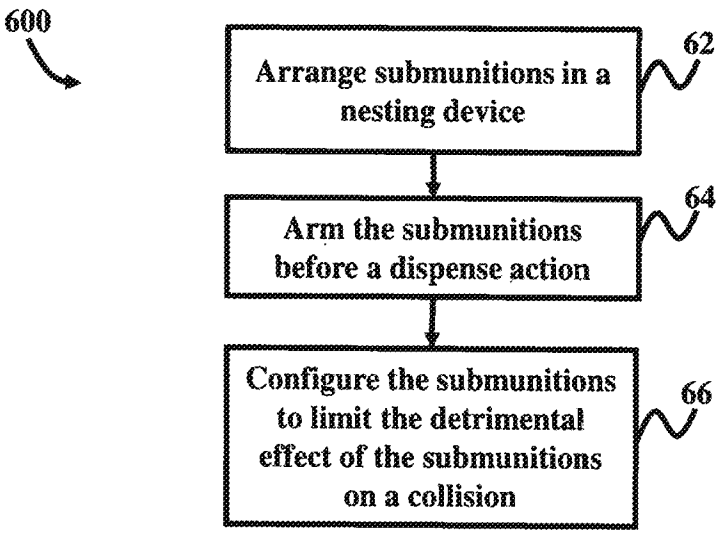
FIG. 6 is a flow diagram illustrating a method for operating a submunition delivery system according to an embodiment herein.

FIG. 6, with reference to FIGS. 1 through 5H, is a flow diagram illustrating a method 600 for operating a submunition delivery device 100 according to an embodiment herein. In step 62, method 600 arranges the submunitions 15 in the nesting device 24. At step 64, method 600 may arm the submunitions 15, using for example distributed fuze architecture 300 or 350, before a dispense action. At step 66, method 600 may configure the submunitions 15, using the distributed fuze architecture, to limit the detrimental effect of the submunitions 15 on a collision.

A distributed fuze architecture (DFA) may arm all submunitions before the dispense action. The DFA may control the arming scenario more precisely. The DFA may limit the detrimental effect of submunition on submunition collisions. The DFA may increase reliability and allow the round to meet 1% unexploded ordnance (UXO) requirements. The DFA also may have the potential to reduce the cost of the submunition delivery device 100. The DFA may require a single instance of certain electronic devices, such as environmental sensors, in the master electronics module 12. The DFA may replace the traditional mechanical stab firing pin detonator (M55) with an electronic detonator that is sensitive to off angle of attack.

Some components of the embodiments herein can include a computer program product configured to include a pre-configured set of instructions stored in non-volatile memory, which when performed, can result in actions as stated in conjunction with the methods described above. In an embodiment, the computer program may provide for programming or configuring a processor, or an FPGA, or any other programmable hardware in the master electronic unit or in the electronic submunition fuze 16. The computer program may provide for electronically controlling arming of the submunitions 15 in a timely manner in an embodiment. The computer program may also provide for controlling the timing of the aero-element deployment expulse sequence. Control functions provided by the computer program may be remotely managed according to an embodiment.

In an example, the pre-configured set of instructions can be stored on a tangible non-transitory computer readable medium or a program storage device. In an example, the tangible non-transitory computer readable medium may be configured to include the set of instructions, which when performed by a device, may cause the device to perform acts similar to the ones described here.

The embodiments herein may also include tangible and/or non-transitory computer-readable storage media for carrying or having computer executable instructions or data structures stored thereon. Such non-transitory computer readable storage media can be any available media that can be accessed by a special purpose computer, including the functional design of any special purpose processor, module, or circuit as discussed above. By way of example, and not limitation, such non-transitory computer-readable media can include RAM, ROM, EEPROM, CD-ROM or other optical disk storage, magnetic disk storage or other magnetic storage devices, or any other medium which can be used to carry or store desired program code means in the form of computer executable instructions, data structures, or processor chip design. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a special purpose computer or special purpose processing device to perform a certain function or group of functions. Computer-executable instructions also include program modules that are executed by computers in stand-alone or network environments. Generally, program modules include routines, programs, components, data structures, objects, and the functions inherent in the design of special-purpose processors, etc. that perform particular tasks or implement particular abstract data types. Computer executable instructions, associated data structures, and program modules represent examples of the program code means for executing steps of the methods disclosed herein. The particular sequence of such executable instructions or associated data structures represents examples of corresponding acts for implementing the functions described in such steps.

The techniques provided by the embodiments herein may be implemented on an integrated circuit chip (not shown). The chip design is created in a graphical computer programming language, and stored in a computer storage medium (such as a disk, tape, physical hard drive, or virtual hard drive such as in a storage access network). If the designer does not fabricate chips or the photolithographic masks used to fabricate chips, the designer transmits the resulting design by physical means (e.g., by providing a copy of the storage medium storing the design) or electronically (e.g., through the Internet) to such entities, directly or indirectly. The stored design is then converted into the appropriate format (e.g., GDSII) for the fabrication of photolithographic masks, which typically include multiple copies of the chip design in question that are to be formed on a wafer. The photolithographic masks are utilized to define areas of the wafer (and/or the layers thereon) to be etched or otherwise processed.

The resulting integrated circuit chips can be distributed by the fabricator in raw wafer form (that is, as a single wafer that has multiple unpackaged chips), as a bare die, or in a packaged form. In the latter case, the chip is mounted in a single chip package (such as a plastic carrier, with leads that are affixed to a motherboard or other higher level carrier) or in a multichip package (such as a ceramic carrier that has either or both surface interconnections or buried interconnections). In any case, the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor, and may be configured, for example, as a kiosk.

The embodiments herein can include both hardware and software elements. The embodiments that are implemented in software include but are not limited to, firmware, resident software, microcode, etc. Furthermore, the embodiments herein can take the form of a computer program product accessible from a computer-usable or computer-readable medium providing program code for use by or in connection with a computer or any instruction execution system. For the purposes of this description, a computer-usable or computer readable medium can be any apparatus that can comprise, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk—read only memory (CD-ROM), compact disk—read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output (I/O) devices (including but not limited to keyboards, displays, pointing devices, etc.) can be coupled to the system either directly or through intervening I/O controllers. Network adapters may also be coupled to the system to enable the data processing system to become coupled to other data processing systems or remote printers or storage devices through intervening private or public networks. Modems, cable modem and Ethernet cards are just a few of the currently available types of network adapters.

Figure 7:
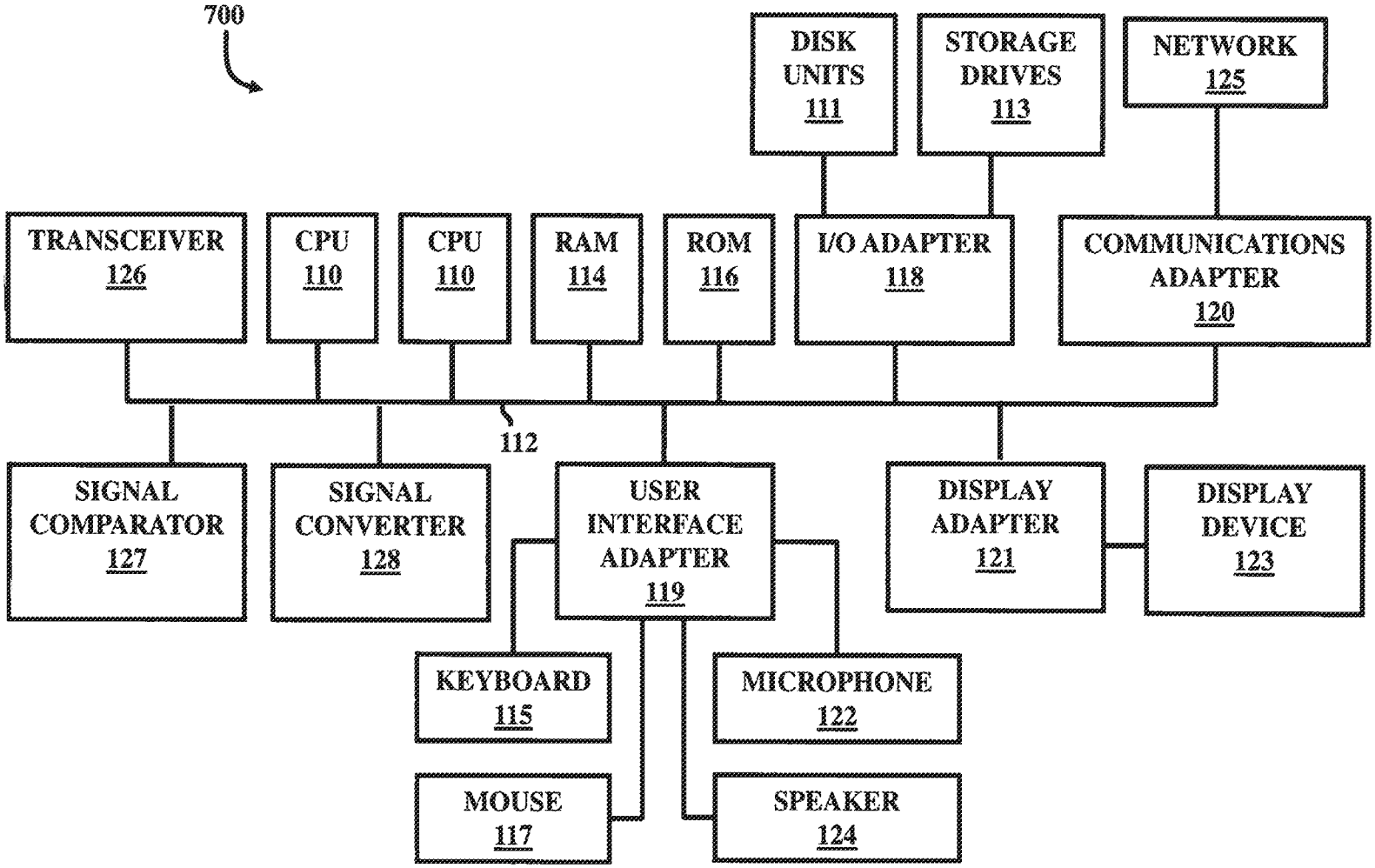
FIG. 7 is a schematic diagram illustrating an exemplary computer architecture used in accordance with the embodiments herein.

A representative hardware environment for practicing the embodiments herein is depicted in FIG. 7, with reference to FIGS. 1 through 6. This schematic drawing illustrates a hardware configuration of an information handling/computer system 700 in accordance with an exemplary embodiment herein. The system 700 comprises at least one processor or central processing unit (CPU) 110. The CPUs 110 are interconnected via system bus 112 to various devices such as a random access memory (RAM) 114, read-only memory (ROM) 116, and an input/output (I/O) adapter 118. The I/O adapter 118 can connect to peripheral devices, such as disk units 111 and storage drives 113, or other program storage devices that are readable by the system. The system 700 can read the inventive instructions on the program storage devices and follow these instructions to execute the methodology of the embodiments herein. The system 700 further includes a user interface adapter 119 that connects a keyboard 115, mouse 117, speaker 124, microphone 122, and/or other user interface devices such as a touch screen device (not shown) to the bus 112 to gather user input. Additionally, a communication adapter 120 connects the bus 112 to a data processing network 125, and a display adapter 121 connects the bus 112 to a display device 123 which may be embodied as an output device such as a monitor, printer, or transmitter, for example. Further, a transceiver 126, a signal comparator 127, and a signal converter 128 may be connected with the bus 112 for processing, transmission, receipt, comparison, and conversion of electric or electronic signals.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of exemplary embodiments, those skilled in the art will recognize that the embodiments herein can be practiced with modification within the spirit and scope of the appended claims.

What is claimed is:

1. A submunition delivery device, comprising:

a master electronics module;

a submunition module operatively being connected to said master electronics module and comprising a plurality of submunition banks being separated by bulkheads, wherein each of said submunition banks includes a plurality of submunitions;

a base plug module operatively being connected to said submunition module; and a distributed fuze module being operatively connected to said master electronics module for limiting a detrimental effect of said plurality of submunitions upon a collision by arming said plurality of submunitions before a dispense action, wherein each of said plurality of submunitions comprises:

a warhead;

a fuze can adaptor connected to said warhead;

an electronic submunition fuze operatively connected to said warhead, wherein said electronic submunition fuze comprises at least one of a high voltage fireset with initiator and a microelectromechanical systems (MEMS) safe and arm device; and a plurality of aero-dynamic elements operatively connected to a submunition, wherein said plurality of aero-dynamic elements comprises any of fins, parachutes, and air-decelerators.

2. The device of claim 1, wherein said master electronic module comprises a single instance of an electronic device.

3. The device of claim 2, wherein said single instance of an electronic device comprises environmental sensors.

4. The device of claim 1, wherein said distributed fuze module comprises an electronic detonator configured to be sensitive to off angle of attack.

5. The device of claim 1, wherein said plurality of aero-dynamic elements are mounted around the periphery of the submunition, wherein said plurality of aero-dynamic elements each have a retracted position and an extended position, and wherein in said extended position, said plurality of aero-dynamic elements extend generally radially from a longitudinal axis of said submunition.

6. The device of claim 1, wherein each of said plurality of submunitions further comprises a plurality of first connectors wherein said first connectors comprise any of contact pins and first plugs.

7. The device of claim 1, further comprising a nestling device, wherein each of said plurality of submunitions further comprises a plurality of first connectors, wherein said plurality of first connectors comprise any of contact pins and first plugs, wherein said nesting device comprises a spacer material and a plurality of elongated openings in said spacer material, and wherein a diameter of each of said elongated openings is complementary to a diameter of each of said submunitions.

8. The device of claim 1, further comprising a nestling device, wherein each of said plurality of submunitions further comprises a plurality of first connectors, wherein said plurality of first connectors comprise any of contact pins and first plugs, wherein said nesting device comprises a spacer material and a plurality of elongated openings in said spacer material, wherein a diameter of each of said elongated openings is complementary to a diameter of each of said submunitions, wherein each of said elongated openings comprises a plurality of second connectors, wherein said plurality of second connectors comprises any of a plurality of strips in broached t-slots and a plurality of second plugs on electronic cables, and wherein said first connectors and said second connectors are configured to connect said electronic submunition fuze of each of said submunitions to said master electronic module.

9. The device of claim 1, wherein each of said plurality of submunitions further comprises a plurality of first connectors, wherein said plurality of first connectors comprise any of contact pins and first plugs, wherein said nesting device comprises a spacer material and a plurality of elongated openings in said spacer material, wherein a diameter of each of said elongated openings is complementary to a diameter of each of said submunitions, wherein each of said elongated openings comprises a plurality of second connectors, wherein said plurality of second connectors comprises any of a plurality of strips in broached t-slots and a plurality of second plugs on electronic cables, wherein said first connectors and said second connectors are configured to connect said electronic submunition fuze of each of said submunitions to said master electronic module, and wherein a number of said plurality of first connectors of each of said plurality of submunitions is equal to a number of said plurality of second connectors of each of said elongated openings.

10. The device of claim 1, wherein each of said plurality of submunitions further comprises a plurality of first connectors, wherein said plurality of first connectors comprise any of contact pins and first plugs, wherein said nesting device comprises a spacer material and a plurality of elongated openings in said spacer material, wherein a diameter of each of said elongated openings is complementary to a diameter of each of said submunitions, wherein each of said elongated openings comprises a plurality of second connectors, wherein said plurality of second connectors comprises any of a plurality of strips in broached t-slots and a plurality of second plugs on electronic cables, wherein said first connectors and said second connectors are configured to connect said electronic submunition fuze of each of said submunitions to said master electronic module, and wherein said plurality of strips comprise brass material and said electronic cables comprised of at least one of copper and polyamide based material.

11. A submunition delivery system, comprising:

a dispense fuze;

a master electronics module being operatively connected to said dispense fuze and being configured for including a single instance of an electronic device in said master electronic module;

a submunition module being operatively connected to said master electronics module and comprising a plurality of submunition banks being separated by bulkheads, wherein each submunition bank includes a plurality of elongated submunitions of similar sizes; and a base plug being operatively connected to said submunition module, wherein each of said plurality of submunitions comprises:

a warhead;

a fuze can adaptor connected to said warhead;

an electronic submunition fuze operatively connected to said warhead, wherein said electronic submunition fuze comprises at least one of a high voltage fireset with initiator and a microelectromechanical systems (MEMS) safe and arm device; and a plurality of aero-dynamic elements operatively connected to a submunition, wherein said plurality of aero-dynamic elements comprises any of fins, parachutes, and air-decelerators.

12. The system of claim 11, wherein said plurality of aero-dynamic elements are mounted around the periphery of a submunition, wherein said plurality of aero-dynamic elements includes a retracted position and an extended position, and wherein in said extended position, said plurality of aero-dynamic elements extend generally radially from the longitudinal axis of each of the submunitions.

13. The system of claim 11, wherein each of said plurality of submunitions further comprises a plurality of first connectors, and wherein said plurality of first connectors are comprised of at least one of contact pins and first plugs.

14. The system of claim 11, wherein each of said plurality of submunitions further comprises a plurality of first connectors, wherein said plurality of first connectors are comprised of at least one of contact pins and first plugs, wherein said nesting module comprises a spacer material and a plurality of elongated openings in said spacer material, and wherein a diameter of each of said elongated openings is complementary to a diameter of each of said submunitions.

15. The system of claim 14, wherein said each of said elongated openings comprises a plurality of second connectors, and wherein said plurality of second connectors comprises any of a plurality of strips in broached t-slots and a plurality of second plugs on electronic cables.

16. The system of claim 14, wherein said each of said elongated openings comprises a plurality of second connectors, wherein said plurality of second connectors comprises any of a plurality of strips in broached t-slots and a plurality of second plugs on electronic cables, wherein a number of said plurality of first connectors of each of said plurality of submunitions is equal to a number of said plurality of second connectors of each of said elongated openings, and wherein said first connectors and said second connectors are configured to connect said electronic submunition fuze of each of said submunitions to said master electronic module.

* * * * *